US010621959B2

(12) United States Patent
Gonzalez

(10) Patent No.: US 10,621,959 B2
(45) Date of Patent: Apr. 14, 2020

(54) FINGER GRIP SUPPORT FOR GUITARS

(71) Applicant: Aidan A. Gonzalez, San Antonio, TX (US)

(72) Inventor: Aidan A. Gonzalez, San Antonio, TX (US)

( * ) Notice: Subject to any disclaimer, the term of this patent is extended or adjusted under 35 U.S.C. 154(b) by 0 days.

(21) Appl. No.: 16/215,563

(22) Filed: Dec. 10, 2018

(65) Prior Publication Data

US 2019/0213979 A1 Jul. 11, 2019

Related U.S. Application Data

(60) Provisional application No. 62/570,234, filed on Oct. 10, 2017.

(51) Int. Cl.
*G10D 3/16* (2006.01)

(52) U.S. Cl.
CPC ..... *G10D 3/16* (2013.01)

(58) Field of Classification Search
CPC ..... G10D 3/16
See application file for complete search history.

(56) References Cited

U.S. PATENT DOCUMENTS 9,576,562 B1 * 2/2017 Porter ..... G10D 1/08

* cited by examiner

*Primary Examiner* — Kimberly R Lockett
(74) *Attorney, Agent, or Firm* — Kammer Browning PLLC

(57) ABSTRACT

A finger grip support brace for guitars and other stringed instruments that helps station the hand for picking by providing support utilized by the little finger or other fingers thus securely placing the hand in an accurate and consistent position over the strings.

8 Claims, 8 Drawing Sheets

FINGER GRIP SUPPORT FOR GUITARS

CROSS REFERENCES TO RELATED APPLICATIONS

This application claims the benefit under Title 35 United States Code § 119(e) of U.S. Provisional Patent Application Ser. No. 62/570,234; Filed: Oct. 10, 2017; the full disclosure of which is incorporated herein by reference.

BACKGROUND OF THE INVENTION

1. Field of the Invention

The present invention relates generally to musical instruments and more particularly to stringed musical instruments. The present invention relates more specifically to ancillary devices configured to be attachable to stringed instruments to facilitate the holding of the instrument and the picking or strumming of the strings on the instrument

2. Description of the Related Art

When picking the guitar, some picking techniques require the guitarist to hold on to the guitar with their little finger or other fingers to provide support for the hand, so consistent and accurate hand placement over the strings can be achieved. The guitarist has only a few options for finger gripping that are available on any guitar that are generally not intended for such use. The pickup, pickup ring, back bridge or even the body of the guitar are the current options as possible finger braces. The comfort of these options can vary, and each guitarist has different challenges that make any of these options not preferable. For example, on a Gibson Les Paul with two pickups, a guitarist who is used to gripping the pickup or pickup ring and then wants to pick in the center of the strumming area, has no pickup to grab on to and has to use the first (E) string as a grip if they are not picking it at the time.

Ideally, a finger brace should be near and below the first string for the grip and comfort to be effective and the current options are not designed for this and therefore are in the wrong place for an effective grip.

SUMMARY OF THE INVENTION

In fulfillment of the above objectives and solving the above described problems, the present invention provides a device specifically for finger gripping by providing an optimal location that is preferred for this picking technique by placing a surface that is generally perpendicular to the plane formed by the strings (and the top face of the guitar) and resides below the first string at a specific distance from the edge of the string and runs alongside the distance of the strumming area, parallel to the strings. This generally "L"-shaped or 90 degree angle brace is attached to the guitar on one flat side by the user with preference as to a specific location or a predetermined location according to the attachment screws. The design of this grip will be determined by the type of guitar and the pickups or lack thereof. The consistent design feature of this grip is the 90 degree angled surface perpendicular to the guitar body that runs parallel to the strings. The brace can be attached to the guitar with adhesive, screws, to the pickup ring screws or to the pickup height adjustment screws.

With this invention, a guitarist will have a comfortable grip that gives them the option of hand placement along the entire length of the strumming area. Further objectives of the present invention will become apparent from an understanding of the following detailed description and the attached drawing figures which may be briefly described as follows.

DETAILED DESCRIPTION OF THE PREFERRED EMBODIMENTS

The main element of the invention is the surface that runs parallel to the strings that is perpendicular to the surface of the guitar. This perpendicular surface will reside at a height that is lower than the string height in reference to the body of the guitar. The perpendicular surface will merge into a 90 degree angle, which will provide a flat surface to rest on the guitar and can thereby be attached and provide strength for the brace.

The part of the invention that is attached to the guitar will have preference to what guitar options are available and will have multiple design versions depending on what style guitar or pickup configurations the guitar has.

Figure 1:
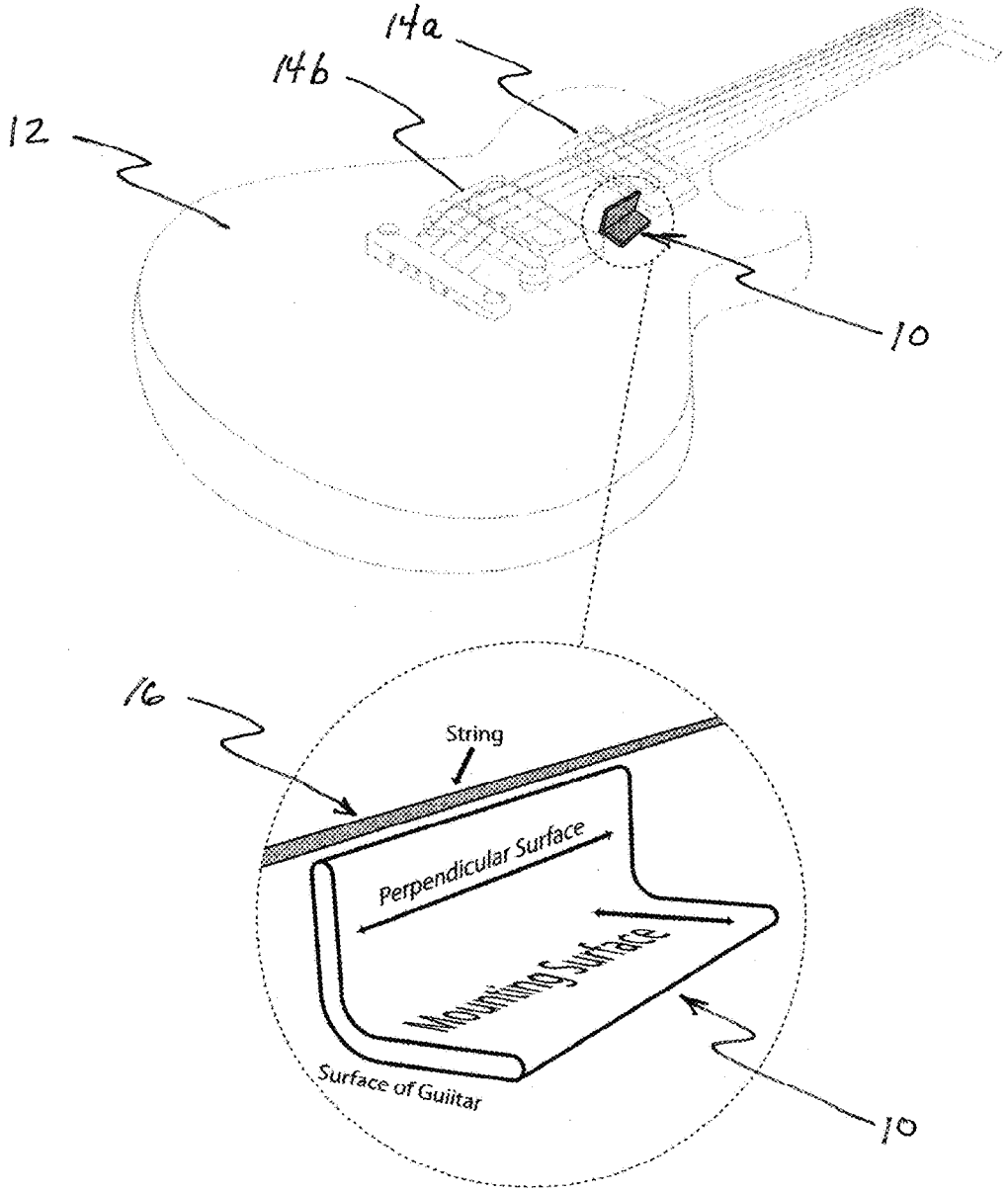
FIG. 1 is a schematic diagram showing the essential elements of the structure of the present invention and its placement and positioning on a guitar.

Reference is made first to FIG. 1 for a schematic diagram showing the essential elements of the structure of the present invention and its placement and positioning on a guitar. Support 10 is generally configured with orthogonal surfaces, one coplanar with the top of guitar 12 and one orthogonal thereto. Both surfaces run generally parallel to the strings 16 of the guitar 12. Placement of the device is preferably below the strings 16 and between the guitar pickup 14*a* & 14*b*. Variations in the structure of the present invention accommodate different numbers of pickups and different guitar structures.

Figure 2:
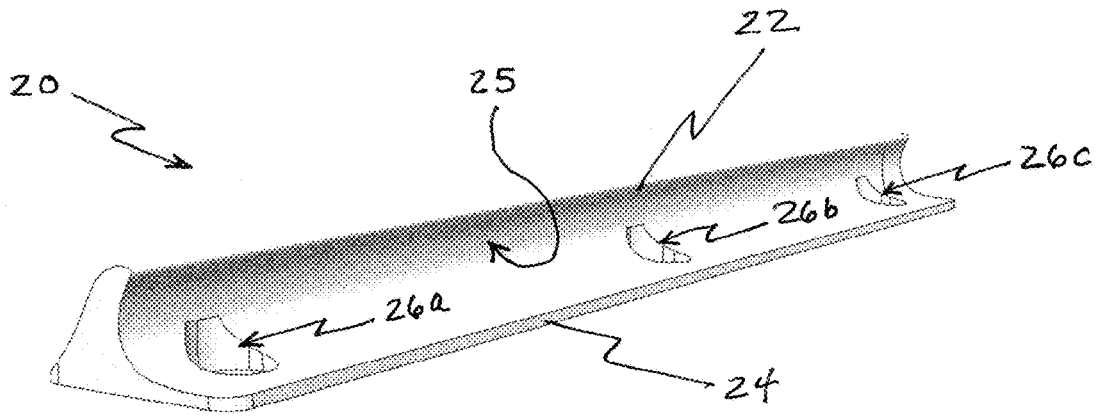
FIG. 2 is a perspective view of a first preferred embodiment of the present invention showing the finger support face side of the device.
Figure 3:
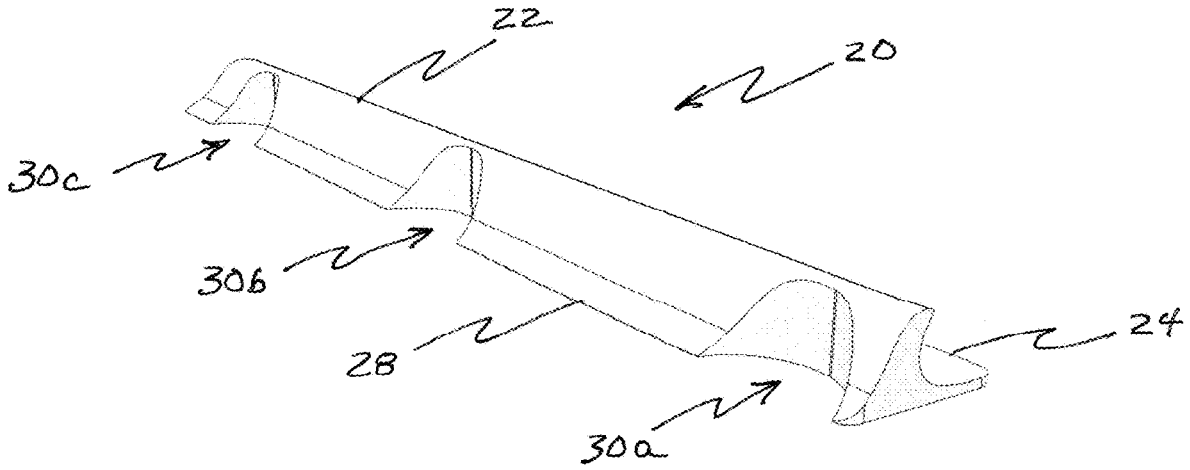
FIG. 3 is a perspective view of the first preferred embodiment of the present invention showing the backside (pickup side) of the device.
Figure 4:
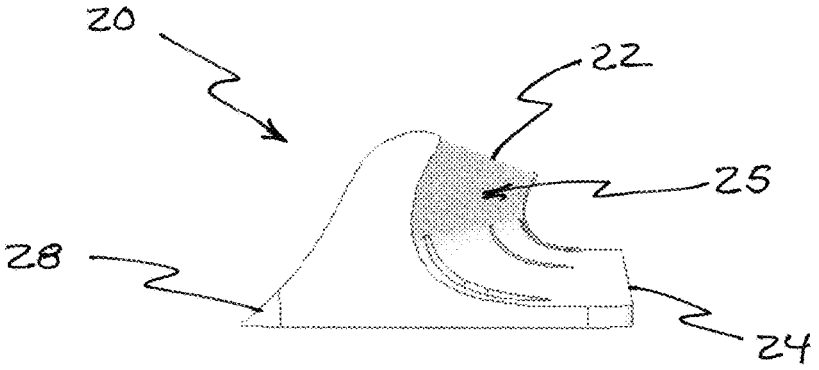
FIG. 4 is an end profile perspective view of the first preferred embodiment of the present invention.
Figure 5:
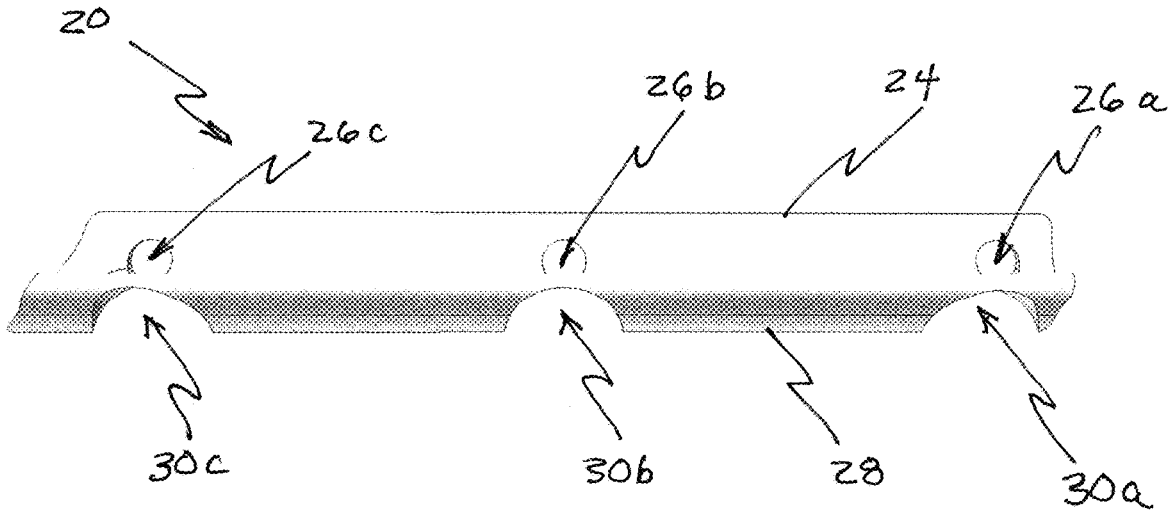
FIG. 5 is a top plan view of the first preferred embodiment of the present invention.

Reference is next made to FIGS. 2-5 which show various views of a first preferred embodiment of the present invention. FIG. 2 is a perspective view showing the finger support face side of the device. FIG. 3 is a perspective view showing the backside (pickup side) of the device. FIG. 4 is an end profile perspective view and FIG. 5 is a top plan view of this first preferred embodiment of the present invention.

Finger support 20 is a generally longitudinal structure with top edge 22 and lower edge 24. In this first embodiment, finger support face 25 curves from a plane perpendicular to the top of the guitar into a base plane coplanar with the top of the guitar. In the view of FIG. 2, attachment apertures 26*a*-26*c* are provided to align with existing attachment devices securing three (in this example) pickups to the top of the guitar. FIG. 3 shows back edge 28 with pickup cutout indentations 30*a*-30*c* that allow the device to nest up against the pickups and preferably utilize their attachment mechanisms. FIG. 5 provides a better view of the alignment of attachment apertures 26*a*-26*c* with pickup indentations 30*a*-30*c*.

Figure 6:
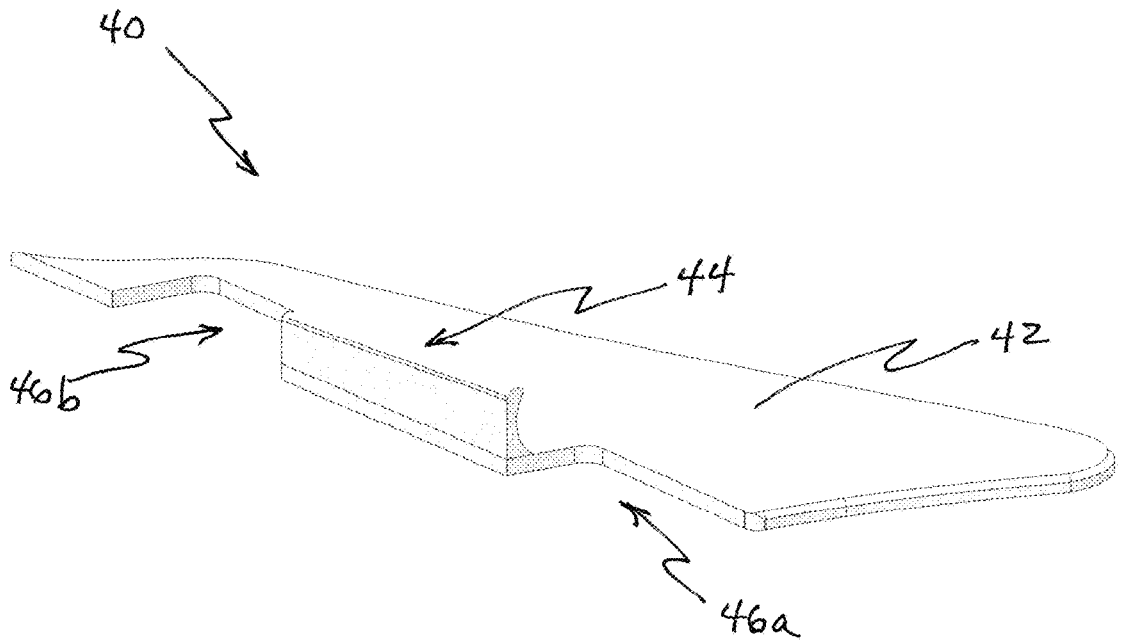
FIG. 6 is a perspective view of a second preferred embodiment of the present invention incorporated into a pick guard showing the backside (pickup side) of the device.
Figure 7:
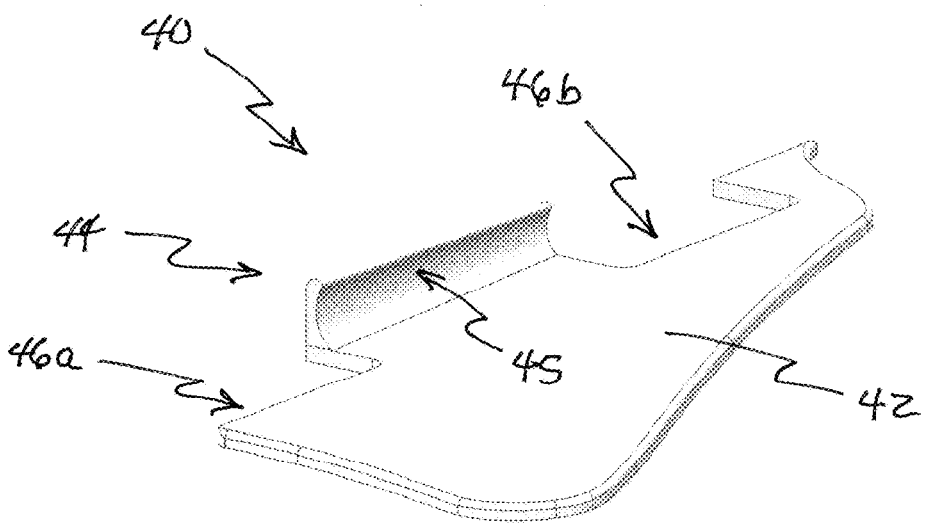
FIG. 7 is a perspective view of the second preferred embodiment of the present invention incorporated into a pick guard showing the finger support face side of the device.

FIG. 6 is a perspective view of a second preferred embodiment of the present invention incorporated into a pick guard showing the backside (pickup side) of the device. FIG. 7 is a perspective view of the second preferred embodiment showing the finger support face side of the device. Integrated structure 40 is made up of finger support 44 incorporated into (or permanently attached to) pick guard 42. Pickup indentations 46*a* & 46*b* allow the device to nest up against the pickups (two in this case) and properly position finger support 44 with finger support face 45 smoothly transitioning into the plane of pick guard 42.

Figure 8:
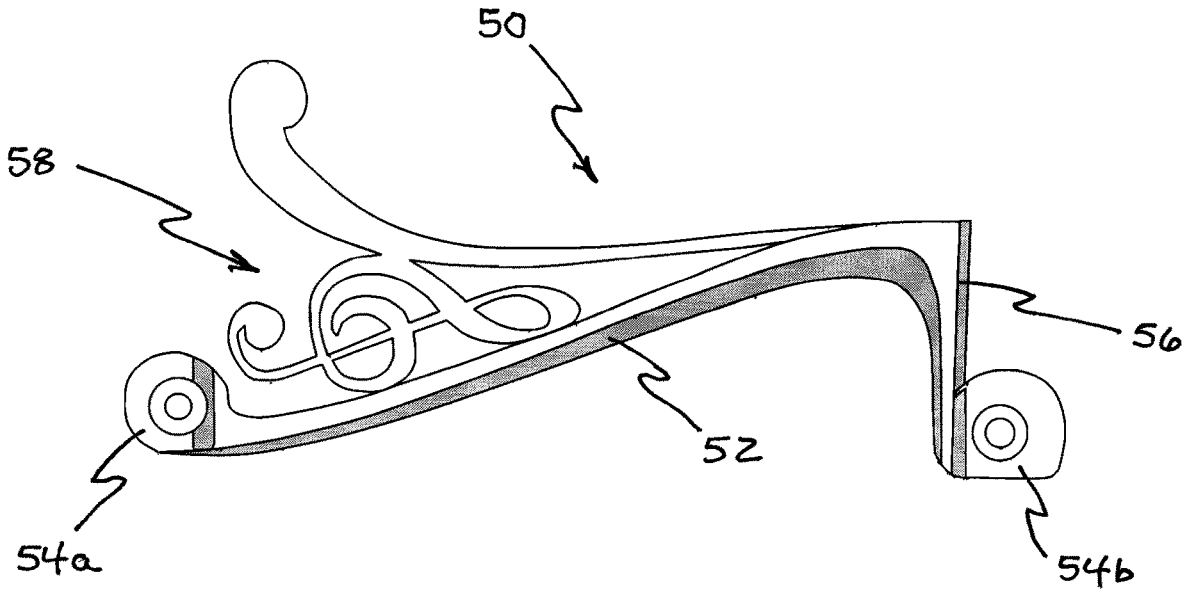
FIG. 8 is a top plan view of a third preferred embodiment of the present invention incorporating a curved finger support face and an ornamental element.

FIG. 8 is a top plan view of a third preferred embodiment of the present invention incorporating a curved finger support face and an ornamental element. Finger support 50 is constructed with curved face 52 extending between arm 56 and first attachment member 54*a*. Second attachment member 54*b* is positioned on the other end of arm 56. Ornamental element 58 may extend from the backside of support 50 in a position beneath the strings (not shown) of the guitar.

Figure 9:
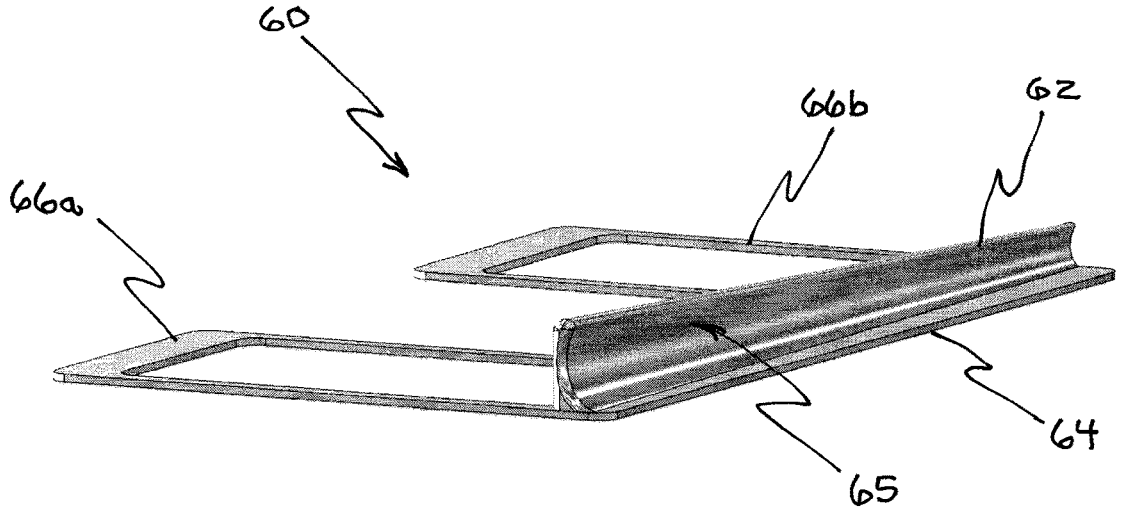
FIG. 9 is a perspective view of a fourth preferred embodiment of the present invention with pickup surrounding attachment members and showing the finger support face side of the device.

FIG. 9 is a perspective view of a fourth preferred embodiment of the present invention with pickup surrounding attachment members and showing the finger support face side of the device. Finger support 60 is constructed with the same basic orthogonal faces with top edge 62 and base edge 64. Finger support face 65 curves between these edges as in the first preferred embodiment described above. Rather than be secured by attachment devices at the end of each pickup (as in the first preferred embodiment) the finger support 60 incorporates pickup ring plates 66*a* & 66*b* which are secured around and tight against the rectangular shaped pickups. Additional means for securing the device of the present invention, such as adhesive surfaces are anticipated.

Figure 10:
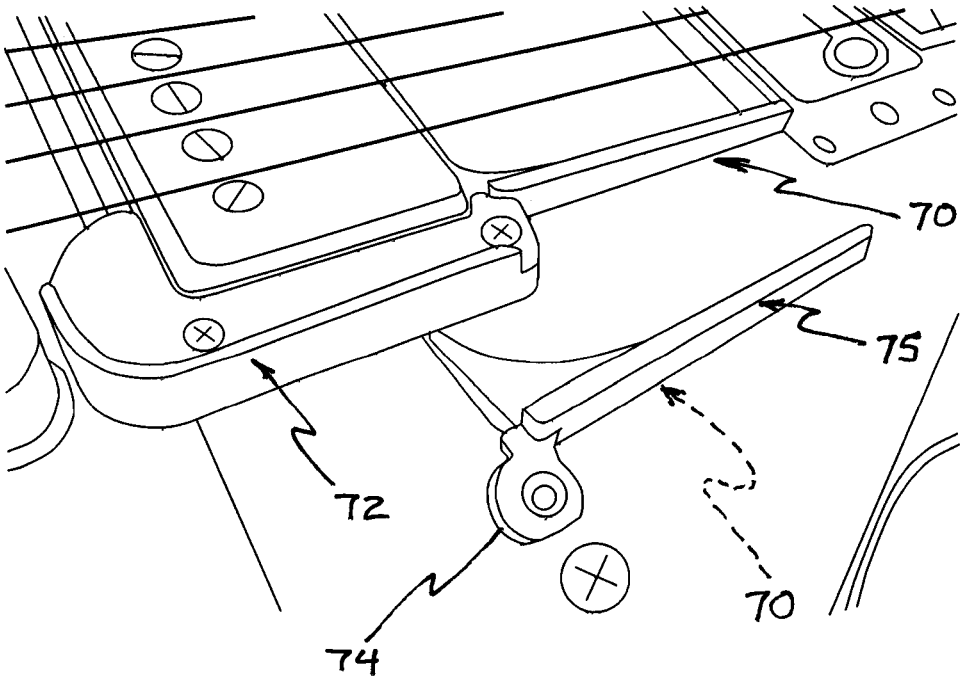
FIG. 10 is a perspective view of a fifth preferred embodiment of the present invention with two pickup attachment members and showing the finger support face side of the device. Two devices are shown in FIG. 10 with one device attached and one device loose for clarity.

FIG. 10 is a perspective view of a fifth preferred embodiment of the present invention with two pickup attachment members and showing the finger support face side of the device. Two devices 70 are shown in FIG. 10 with one device attached and one device loose for clarity. In this embodiment, support member 72 is secured to the end pickup with finger support bar 75 secured separately beneath it (at one attachment point 74) to extend back towards the first pickup. Appropriate apertures are provided to make use of the existing pickup attachment points.

Figure 11:
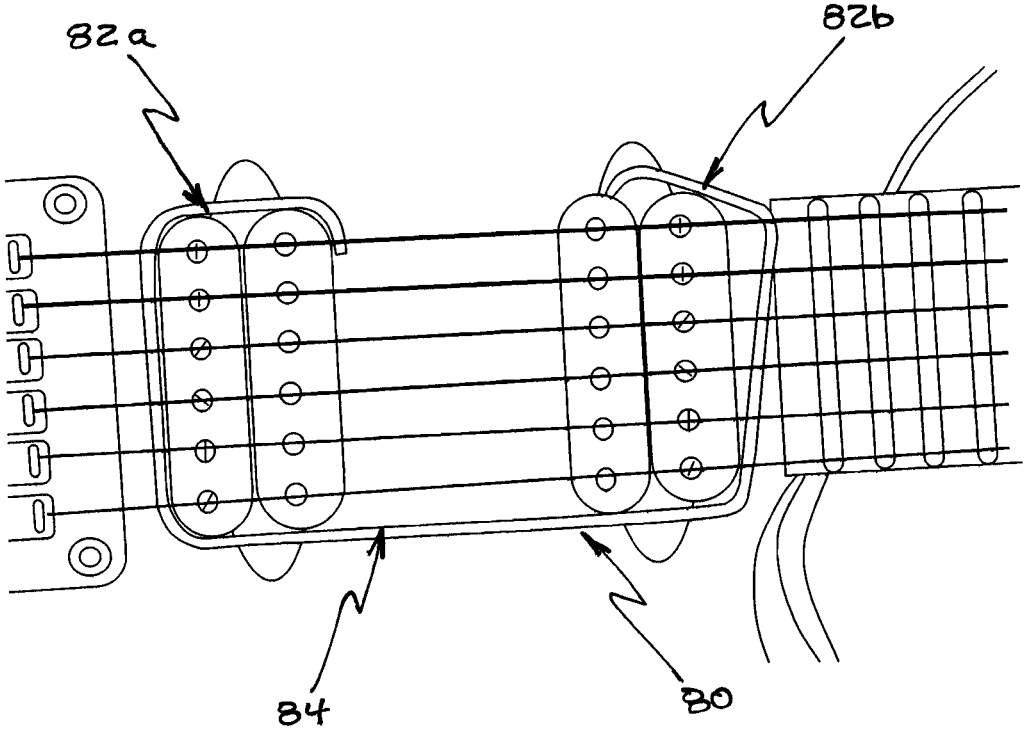
FIG. 11 is a top plan view of a sixth preferred embodiment of the present invention with partial pickup surrounding attachment members.

FIG. 11 is a top plan view of a sixth preferred embodiment of the present invention with partial pickup surrounding attachment members. Finger support 80 in this case is a semi-flexible bar with primary finger support section (face) 84 positioned and attached to the pickups (two in this case) by way of snap around members 82*a* & 82*b*. Once sized for a particular guitar and pickup arrangement finger support 80 may be snapped into place as shown. In the view of FIG. 11, snap around member 82*a* is fully secured while snap around member 82*b* is in the process of being secured.

Figure 12:
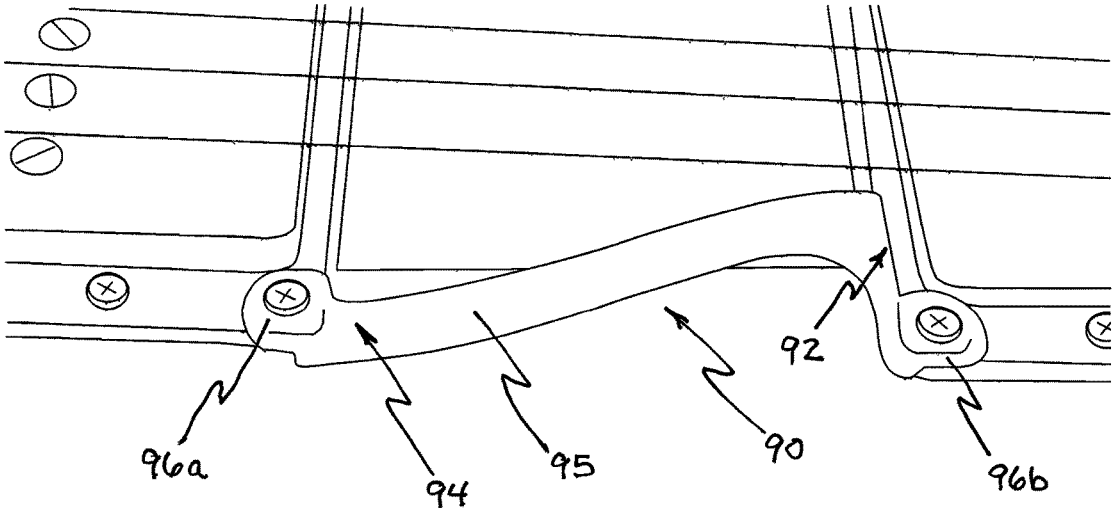
FIG. 12 is a perspective view of a seventh preferred embodiment of the present invention incorporating a curved finger support face positioned between pickups.

FIG. 12 is a perspective view of a seventh preferred embodiment of the present invention incorporating a curved finger support face positioned between pickups that is similar in many respects to the third preferred embodiment described above (FIG. 8). Finger support 90 is constructed with curved face 95 extending between arm 92 and first attachment member 96*a* on the forward end 94 of the device. Second attachment member 96*b* is positioned on the other end of arm 92. As can be seen in FIG. 12 (and as applicable to the device shown in FIG. 8 as well) the "deep" end of the curved bar still falls outside of the first guitar string. The angle created by the curving bar is "friendly" to the manner in which many guitarists prefer to hold (finger support) the device and to move their fingers along the finger support face 95.

Figure 13:
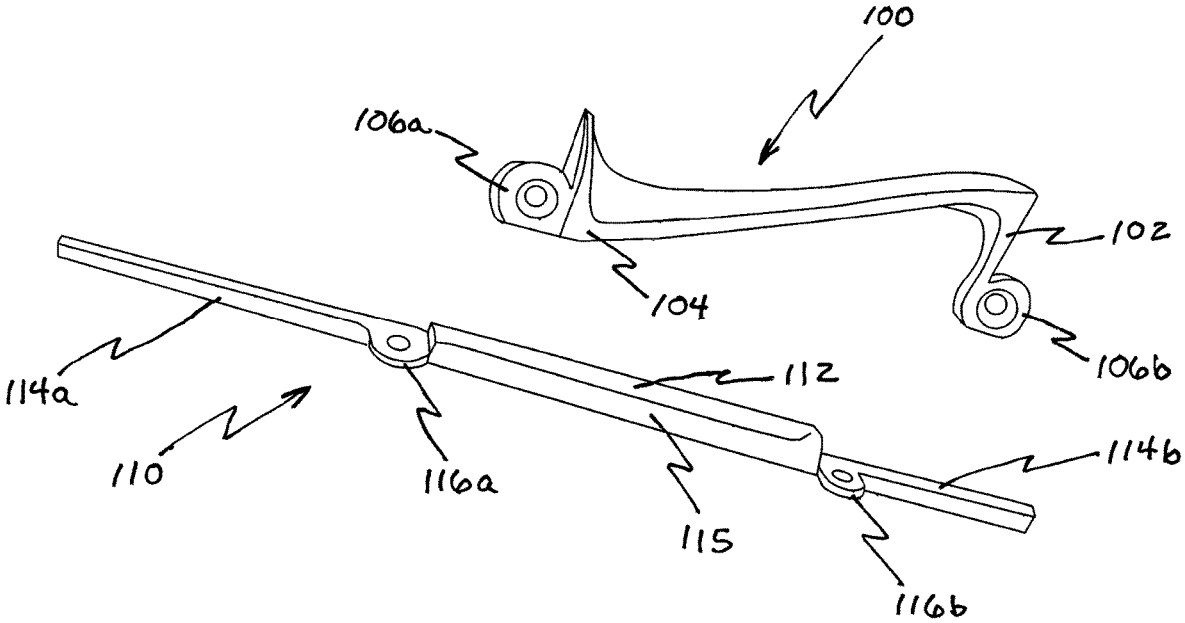
FIG. 13 is a perspective view of a metal version of the seventh preferred embodiment shown in FIG. 12, and a metal version of an eighth preferred embodiment with finger support faces extending across and between pickups.

FIG. 13 is a perspective view of a metal version of the seventh preferred embodiment shown in FIG. 12, and a metal version of an eighth preferred embodiment with finger support faces extending across and between pickups. Finger support 100 curves (or is angled) between arm 102 and forward end 104, again between attachment members 106*a* & 106*b*. The ends of the device are configured to nest up against the respective pickups.

Finger support 110 provides a straight bar that extends between pickups with center portion 112 with finger support face 115. Support 110 further includes pickup cover bars 114*a* & 114*b* that abut the respective pickups to stabilize the device. Attachment of the two devices shown in FIG. 13 is essentially the same as they are generally dimensioned to be secured to the same type of guitar with the same pickup separation distance.

Figure 14:
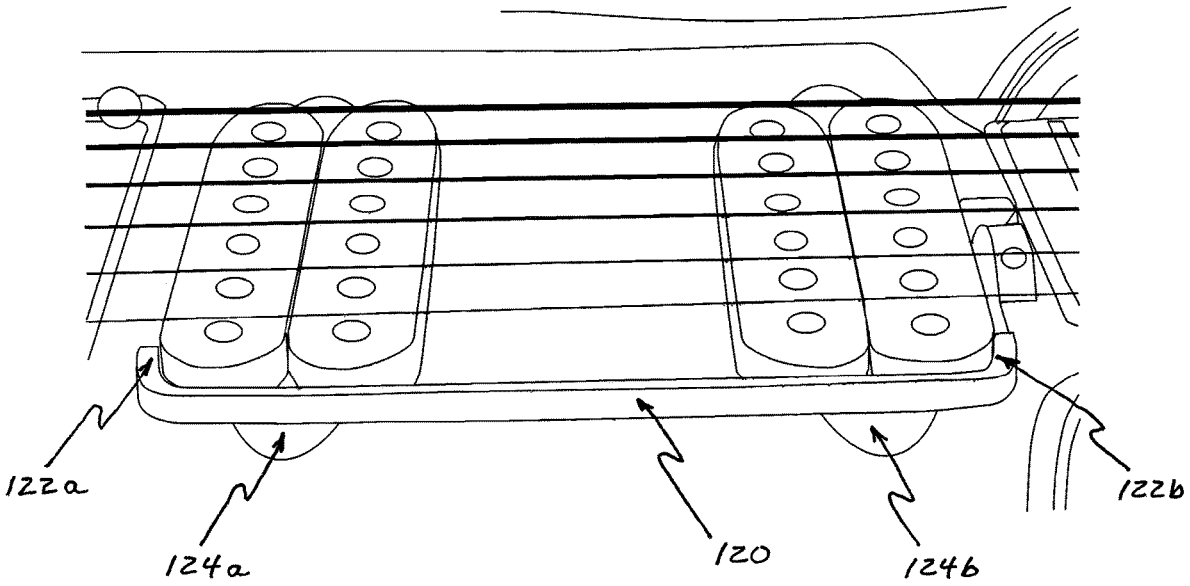
FIG. 14 is a perspective view of a ninth preferred embodiment of the present invention showing the finger support face of the device.

Reference is finally made to FIG. 14 for a perspective view of a ninth preferred embodiment of the present invention showing the finger support face of the device. This structure 120 is perhaps the simplest of the various embodiments as it minimally includes a simple finger support bar extending between two simple attachment pads or points 124*a* & 124*b*. The ends of the device are curved inward at end points 122*a* & 122*b* primarily to allow the fingers to smoothly engage the bar as they might slide along its length. A similar design suitable for use with three pickups (instead of the two shown here) would add a third attachment point midway along the length of the device (or at whatever distance the middle pickup is positioned at). The device shown in FIG. 14, as most of the embodiments of the present invention, may be made of metal or plastic. Other rigid or semi-rigid materials such as hardwoods and 3D printer fabricated components may also be used.

Although the present invention has been described in terms of the foregoing preferred embodiments, this description has been provided by way of explanation only and is not intended to be construed as a limitation of the invention. Those skilled in the art will recognize modifications in the present invention that might accommodate specific guitars or other stringed instruments. Such modifications as to structure, method of attachment, and even the specific arrangement of components, where such modifications are coincidental to the guitar, the pickups, the guitarist's preferences, or the specific type of musical instrument, do not necessarily depart from the spirit and scope of the invention.

I claim:

1. An apparatus for providing finger grip support for a stringed musical instrument, the musical instrument having a plurality of parallel strings and a top surface above which the plurality of strings extend, the apparatus comprising:

a longitudinal finger support face oriented in a plane generally perpendicular to the top surface of the musical instrument and generally parallel to the plurality of strings, the finger support face positioned adjacent but separated from the plurality of strings below a region of the plurality of strings where the strings are plucked or strummed, the support face extending up from the top surface of the musical instrument to a level less than the separation of the plurality of strings from the top surface of the musical instrument, the finger support face having a length sufficient to allow multiple fingers of the user to move longitudinally along the support face while remaining in full contact with the support face;

a support and attachment member integrated into the finger support face and generally parallel to the plane of the top surface of the musical instrument; and means for fixing the support and attachment member to the top surface of the musical instrument below the region of the plurality of strings where the strings are plucked or strummed.

2. The apparatus of claim 1 wherein the finger support face comprises a generally flat planar rectangular surface having a length dimension greater than a height dimension.

3. The apparatus of claim 1 wherein the finger support face comprises a curved surface with a concave profile on a side away from the plurality of strings, the curved surface of the support face having a length dimension greater than a height dimension, the curved surface defining a channel within which the fingers of the user may slide longitudinally along the length of the support face.

4. The apparatus of claim 1 wherein the finger support face comprises a surface angled with respect to the direction of the plurality of strings, a first end of the support face positioned towards the neck of the instrument close to the plurality of strings with a second opposite end of the support face positioned further from the plurality of strings.

5. The apparatus of claim 1 wherein the means for fixing the support and attachment member to the top surface of the musical instrument comprises an adhesive material between the top surface of the instrument and the support and attachment member.

6. The apparatus of claim 1 wherein the means for fixing the support and attachment member to the top surface of the musical instrument comprises a plurality of apertures position through the support and attachment member aligned with a plurality of apertures positioned through or into the top surface of the instrument, each aligned pair of apertures secured together therethrough with a screw.

7. The apparatus of claim 1 wherein the means for fixing the support and attachment member to the top surface of the musical instrument comprises one or more clip members extending around one or more pick-up arrays positioned on the top surface of the instrument.

8. The apparatus of claim 1 further comprising a pick guard integrated into the support and attachment member, the pick guard further serving as part of the means for fixing the support and attachment member to the top surface of the guitar.

* * * * *